US010273976B2

(12) United States Patent
Jemora et al.

(10) Patent No.: US 10,273,976 B2
(45) Date of Patent: Apr. 30, 2019

(54) ACTIVELY MORPHABLE VANE

(71) Applicant: General Electric Company, Schenectady, NY (US)

(72) Inventors: Daniel Jemora, Veltheim (CH); Damir Novak, Eggenwil (CH); Hermann Nachtigall, Wettingen (CH)

(73) Assignee: General Electric Company, Schenectady, NY (US)

( * ) Notice: Subject to any disclaimer, the term of this patent is extended or adjusted under 35 U.S.C. 154(b) by 290 days.

(21) Appl. No.: 15/423,627

(22) Filed: Feb. 3, 2017

(65) Prior Publication Data

US 2018/0223867 A1 Aug. 9, 2018

(51) Int. Cl.

| | |
|---|---|
| ***F04D 27/02*** | (2006.01) |
| ***F04D 29/54*** | (2006.01) |
| ***F04D 29/56*** | (2006.01) |

(52) U.S. Cl.

CPC ..... *F04D 29/563* (2013.01); *F04D 27/0246* (2013.01); *F04D 29/542* (2013.01)

(58) Field of Classification Search

CPC .. F04D 29/563; F04D 27/0246; F04D 29/542; F01D 17/162; F01D 5/147; F01D 17/14; F01D 7/00; F01D 5/148; B64C 3/46; B64C 2027/7283

See application file for complete search history.

(56) References Cited

U.S. PATENT DOCUMENTS

| | | | | |
|---|---|---|---|---|
| 3,723,021 | A * | 3/1973 | Bartholomew | F01D 5/148 415/147 |
| 4,695,220 | A * | 9/1987 | Dawson | F04D 29/563 415/156 |
| 7,114,911 | B2 | 10/2006 | Martin et al. | |
| 7,632,064 | B2 | 12/2009 | Somanath et al. | |
| 8,011,882 | B2 * | 9/2011 | McMillan | F01D 5/147 415/148 |
| 9,004,850 | B2 | 4/2015 | Nichols et al. | |
| 10,024,186 | B2 * | 7/2018 | Hennequin | B23P 15/04 |
| 2010/0260591 | A1 | 10/2010 | Martin et al. | |

* cited by examiner

*Primary Examiner* — Alexander B Comley
*Assistant Examiner* — Benjamin Doyle
(74) *Attorney, Agent, or Firm* — Dority & Manning, P.A.

(57) ABSTRACT

An actively morphable vane includes a leading edge, a trailing edge downstream of the leading edge, a tip end, a hub end spaced radially outward from the tip end, a pressure side comprising a pressure surface, and a suction side comprising a suction surface. The pressure surface extends continuously between the tip end, the hub end, the leading edge, and the trailing edge. The suction side is positioned opposite of the pressure side and the suction surface extends continuously between the tip end, the hub end, the leading edge, and the trailing edge. The actively morphable stator vane also includes an actuator in mechanical communication with the tip end. The actuator is operable to selectively morph the actively morphable stator vane between a first configuration and a second configuration. The first configuration is optimized for a first operating condition, and the second configuration is optimized for a second operating condition.

10 Claims, 6 Drawing Sheets

ACTIVELY MORPHABLE VANE

FIELD

The present subject matter relates generally to turbomachines and, more particularly, to actively morphable vanes for turbomachines.

BACKGROUND

Turbomachines are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

A typical compressor for a gas turbine may be configured as a multi-stage axial compressor and may include both rotating and stationary components. A shaft drives a central rotor drum or wheel, which has a number of annular rotors. Rotor stages of the compressor rotate between a similar number of stationary stator stages, with each rotor stage including a plurality of rotor blades secured to the rotor wheel and each stator stage including a plurality of stator vanes secured to an outer casing of the compressor. During operation, airflow passes through the compressor stages and is sequentially compressed, with each succeeding downstream stage increasing the pressure until the air is discharged from the compressor outlet at a maximum pressure.

In order to improve the performance of a compressor, one or more of the stator stages may include variable stator vanes, or variable vanes, configured to be rotated about their longitudinal or radial axes. Such variable stator vanes generally permit compressor efficiency and operability to be enhanced by controlling the amount of air flowing into and through the compressor by varying the angle at which the stator vanes are oriented relative to the flow of air.

In particular gas turbines, the compressor section may include a row of inlet guide vanes disposed generally adjacent to an inlet of the compressor section. In addition or in the alternative, the compressor section may include a row of variable stator vanes downstream from the inlet guide vanes. In certain gas turbine designs, the compressor section may include multiple rows of the variable stator vanes. Typically, a row of rotor blades is disposed between the inlet guide vanes and the variable stator vanes. During various operating conditions, such as startup and shut down of the gas turbine, the inlet guide vanes and the variable stator vanes may be actuated between an open position and a closed position so as to increase or decrease a flow rate of the working fluid entering the compressor section of the gas turbine.

When the gas turbine enters an operating condition known in the industry as "part-load operation," the inlet guide vanes and the variable stator vanes are actuated to the closed position or a partially closed condition to reduce or minimize airflow through the gas turbine. This may improve the efficiency of the compressor when the gas turbine is operating in a part-load condition. However, this doesn't optimize the flow condition over the full radial dimension of the vane, in particular for vanes with a large radial dimension. This results in non-optimal, disturbed flow condition either at the vane tip or the vane hub. Due to the different flow conditions at different radial coordinates, a solid vane with a fixed incidence angle cannot always function optimally under a range of operating load conditions, e.g., baseload and part-load. Usually a vane is designed for a designated operation range, e.g., baseload, which may be less efficient at other operating conditions, such as part-load operations.

BRIEF DESCRIPTION

Aspects and advantages of the invention will be set forth in part in the following description, or may be obvious from the description, or may be learned through practice of the invention.

In accordance with a first embodiment, an actively morphable stator vane for a compressor is provided. The actively morphable stator vane includes a leading edge, a trailing edge downstream of the leading edge, a tip end, a hub end spaced radially outward from the tip end, a pressure side comprising a pressure surface, and a suction side comprising a suction surface. The pressure surface extends continuously between the tip end and the hub end and extends continuously between the leading edge and the trailing edge. The suction side is positioned opposite of the pressure side. The suction surface extends continuously between the tip end and the hub end and extends continuously between the leading edge and the trailing edge. The actively morphable stator vane also includes an actuator in mechanical communication with the tip end. The actuator is operable to selectively morph the actively morphable stator vane between a first configuration and a second configuration. The first configuration is optimized for a first operating condition, and the second configuration is optimized for a second operating condition.

In another exemplary embodiment, a method of operating a turbomachine is provided. The turbomachine includes a compressor. The compressor includes an actively morphable stator vane. The actively morphable stator vane includes a continuous pressure surface and a continuous suction surface. The method includes operating the turbomachine at a first operating condition and configuring the actively morphable stator vane in a first configuration while operating the turbomachine at the first operating condition. The method also includes operating the turbomachine at a second operating condition and configuring the actively morphable stator vane in a second configuration by altering the shape of the continuous pressure surface and the continuous suction surface while operating the turbomachine at the second operating condition.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION

Figure 1:
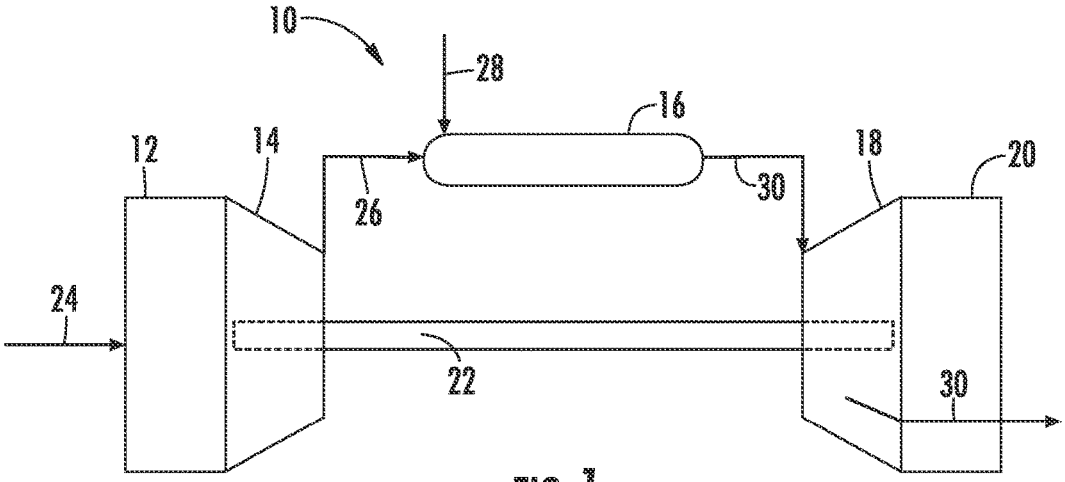
FIG. 1 provides a schematic illustration of a gas turbine which may include embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. For example, the following description uses terms such as "first condition," which may refer to baseload operation, and "second condition," which may refer to part-load operation, and it is understood that part-load operation may include startup operation and/or shutdown operation, such that the terms "first" and "second" do not necessarily connote any chronological sequence. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a land based power generating gas turbine for purposes of illustration, one of ordinary skill in the art will readily appreciate that embodiments of the present disclosure may be applied to any style or type of turbomachine and are not limited to land based power generating gas turbines unless specifically recited in the claims.

Referring now to the drawings, FIG. 1 illustrates a schematic diagram of an exemplary gas turbine 10 that may incorporate various embodiments of the present invention. As shown, the gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades, thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
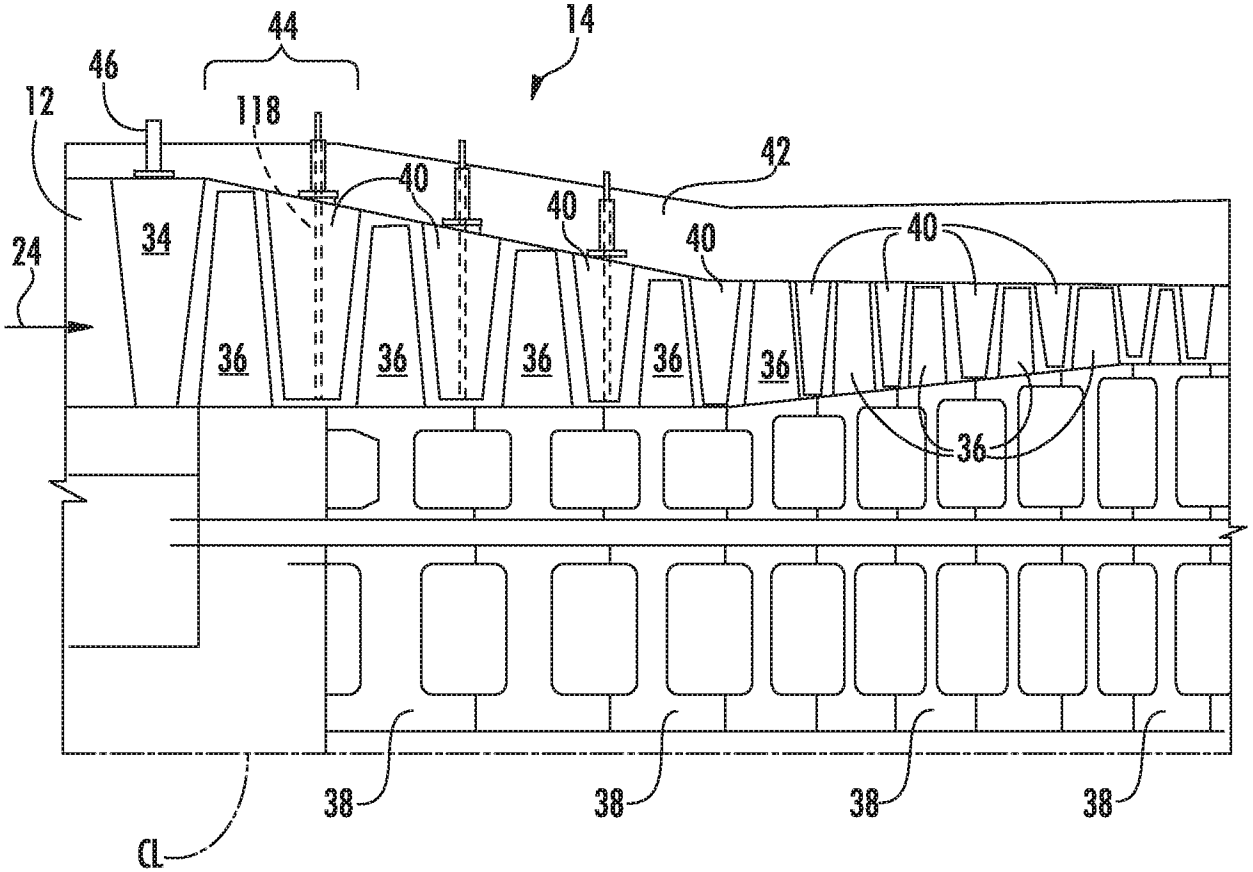
FIG. 2 provides a partial section view of a compressor which may include actively morphable stator vanes according to embodiments of the present disclosure.

Referring now to FIG. 2, a portion of a gas turbine compressor 14 according to at least one embodiment is illustrated. As shown, the compressor 14 generally includes an inlet guide vane 34 disposed at the inlet 12 of the compressor 14. In some embodiments, more than one inlet guide vane 34 may be provided. A plurality of compressor stages 44 may be disposed downstream of the inlet guide vane(s) 34 (the direction of the airflow, as indicated by the arrow 24, is generally along the axial direction). Each compressor stage may generally include a rotor stage having a plurality of rotor blades 36 mounted onto a rotor wheel 38 of the compressor 14 and a stator stage following each rotor stage having a plurality of stator vanes 40 attached to a static casing 42 of the compressor 14. For example, the initial compressor stage 44 of the compressor 14 may correspond to "Stage Zero" of the compressor 14, with subsequent compressor stages being sequentially numbered in the downstream direction of the compressor 14, e.g., "Stage One," "Stage Two," etc. As such, the rotor blades 36 disposed within the initial compressor stage 44 may correspond to "Stage Zero" or "R0" rotor blades 36 and the stator vanes 40 disposed within the initial compressor stage 44 may correspond to "Stage Zero" or "S0" stator vanes 40.

In general, the alternating rows of rotor blades 36 and stator vanes 40 may be designed to bring about a desired pressure rise in the air 24 flowing through the compressor 14. For example, the rotor blades 36 may be configured to impart kinetic energy to the airflow and the stator vanes 40 may be configured to convert the increased rotational kinetic energy within the airflow into increased static pressure through diffusion. Thus, it should be appreciated that the particular configuration of the airfoil included in each rotor blade 36 and/or stator vane 40 (along with its interaction with the surrounding airfoils of adjacent rotor blades 36 and/or stator vanes 40) may generally provide for stage airflow efficiency, enhanced aeromechanics, smooth flow from stage to stage, reduced thermal stresses, enhanced interrelation of the stages to effectively pass the airflow from stage to stage, and reduced mechanical stresses.

As indicated above, each rotor stage may generally include a plurality of circumferentially spaced rotor blades 36 mounted onto one of the rotor wheels 38 about a centerline CL of the compressor 14. The rotor wheels 38 may, in turn, be attached to the drive shaft 22 of the gas turbine 10 (FIG. 1) for rotation therewith. The drive shaft 22 may then be coupled to the turbine section 18 of the gas turbine 10 (FIG. 1) such that the energy extracted within the turbine section 18 may be used to drive the compressor 14. Similarly, each stator stage may generally include a plurality of stator vanes 40 mounted onto the casing 42 and arranged circumferentially about the centerline CL of the compressor 14.

As illustrated in FIGS. 3-8, each stator vane 40 generally includes a leading edge 100, a trailing edge 102 downstream of the leading edge 100, a tip end 104, and a hub end 106 spaced radially outward from the tip end 104. Each stator vane 40 defines a chord C (FIG. 5), which is defined by a straight line extending from the leading edge 100 to the trailing edge 102. As will be discussed further hereinbelow, the angle formed by the chord C and the direction of airflow may vary over the profile of the vane 40. The profile of the vane 40 is the height of the vane 40 along the radial direction. Each stator vane 40 also includes a pressure side 108 and a suction side 112 positioned opposite of the pressure side 108. The pressure side 108 includes a pressure surface 110. The pressure surface 110 may extend continuously between the leading edge 100 and the trailing edge 102 along the axial direction. The pressure surface 110 may extend continuously between the tip end 104 and hub end 106 along the radial direction. The suction side 112 may include a suction surface 114. The suction surface 114 may extend continuously between the leading edge 100 and the trailing edge 102 along the axial direction. The suction surface 110 may extend continuously between the tip end 104 and hub end 106 along the radial direction. Such configuration may be aerodynamically advantageous in that no discontinuities, e.g., seams or joints, are located within the pressure surface 110 or the suction surface 114.

Figure 3:
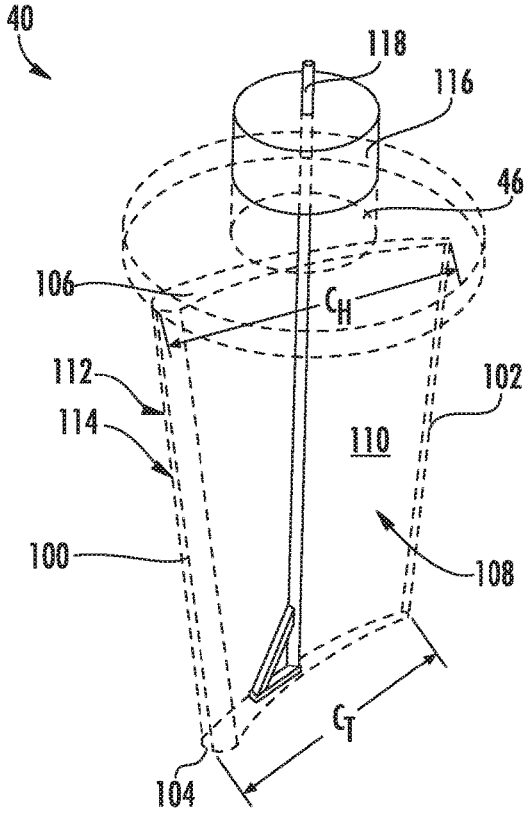
FIG. 3 is a perspective view of an actively morphable stator vane in a first configuration according to embodiments of the present disclosure.
Figure 4:
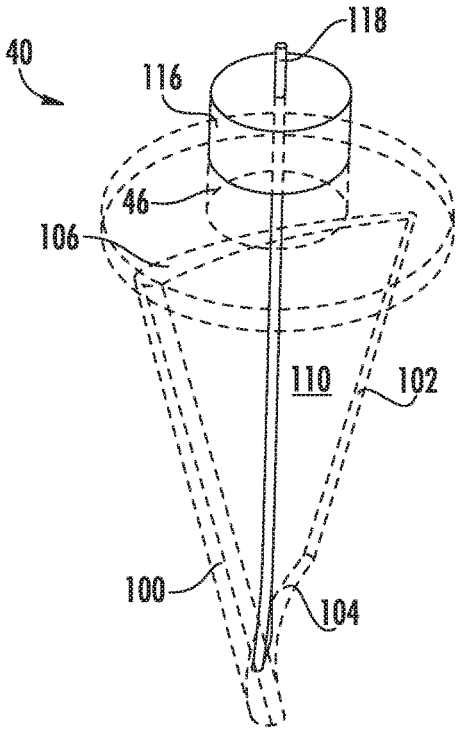
FIG. 4 is a perspective view of the actively morphable stator vane of FIG. 3 in a second configuration.
Figure 5:
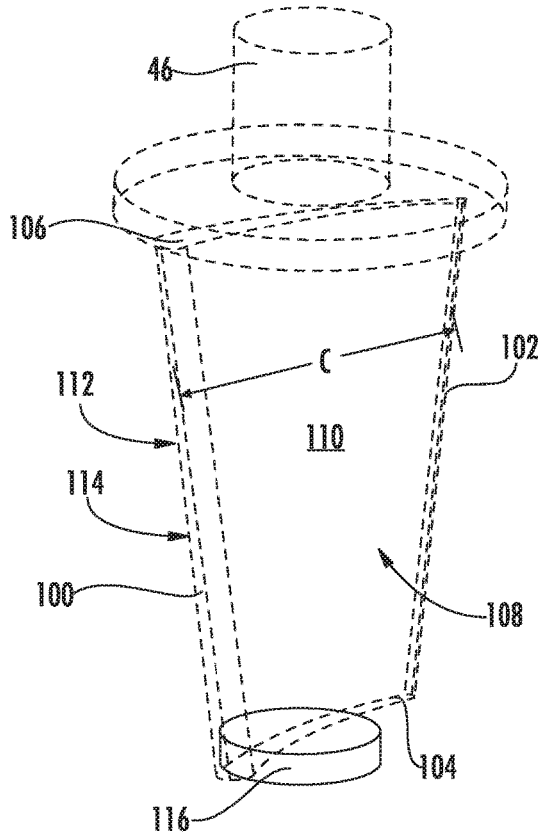
FIG. 5 is a perspective view of an actively morphable stator vane in a first configuration according to embodiments of the present disclosure.
Figure 6:
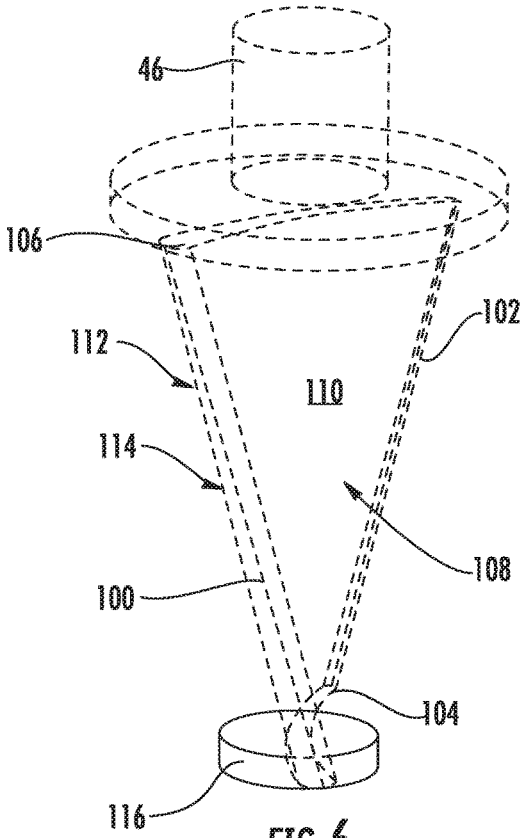
FIG. 6 is a perspective view of the actively morphable stator vane of FIG. 5 in a second configuration.

Also illustrated in FIGS. 3-8, one or more (up to and including all) of the stator vanes 40 may be an actively morphable stator vane 40. The stator vane(s) 40 may be actively morphable by an actuator 116 in mechanical communication with the tip end 104. The actuator 116 may be operable to selectively morph the actively morphable stator vane 40 between a first configuration, e.g., as shown in FIG. 3 or FIG. 5, and a second configuration, e.g., as shown in FIG. 4 or FIG. 6. In some embodiments, the actuator 116 may be operable to selectively morph the actively morphable stator vane 40 by twisting the actively morphable stator vane 40. For example, the actuator 116 may apply a torque to the tip end 104, causing the tip end 104 to rotate relative to the hub end 106, twisting the vane 40 such that the airfoil, and in particular pressure surface 110 and the suction surface 114, will flex. In other embodiments, the actuator 116 may apply torque to the hub end 106, causing the hub end 106 to rotate relative to the tip end 104. The tip end 104 and hub end 106 may be sufficiently rigid such that the tip end 104 and hub end 106 do not change shape when torque is applied, e.g., the surfaces 110 and 114 will flex and change shape, but the tip end 104 and hub end 106 will not flex under the applied torque from actuator 116. Where the tip end 104 and hub end 106 do not change shape, the length of chord C in the first configuration will be substantially the same as the length of chord C in the second configuration, at both the hub end 106 and the tip end 104.

The angle of the chord, in at least part of the vane 40, may vary from the first configuration to the second configuration. The vane 40 may include a tip end chord $C_T$ defined by a straight line extending from the leading edge 100 to the trailing edge 102 at the tip end 104, and a hub end chord $C_H$ defined by a straight line extending from the leading edge 100 to the trailing edge 102 at the hub end 106. The tip end Chord $C_T$ and the hub end chord $C_H$ define an angle therebetween. The angle is larger in the second configuration than in the first configuration. In some embodiments, the tip end chord $C_T$ may be substantially parallel to the hub end chord $C_H$ in the first configuration and the tip end chord $C_T$ may be oblique to the hub end chord $C_H$ in the second configuration. That is, in such embodiments, the angle between the tip end chord $C_T$ and the hub end chord $C_H$ may be about zero in the first configuration, and in such embodiments, the angle will be greater than zero in the second configuration. The second configuration of the vane 40 may be referred to as a twisted configuration, wherein the tip end chord $C_T$ is oblique to the hub end chord $C_H$ in the second configuration. In other embodiments, the vane 40 may be twisted in both the first configuration and the second configuration. That is, in such embodiments, the tip end chord $C_T$ may be oblique to the hub end chord $C_H$ in in both configurations, but will be more oblique (i.e., the angle between the tip end chord $C_T$ and the hub end chord $C_H$ will be larger) in the second configuration.

Further, it should be appreciated that the first configuration may be optimized for a first operating condition, e.g., the first configuration may generally provide for stage airflow efficiency, enhanced aeromechanics, smooth flow from stage to stage, reduced thermal stresses, enhanced interrelation of the stages to effectively pass the airflow from stage to stage, and/or reduced mechanical stresses in the first operating condition, which may be baseload condition. For example, the first configuration may include the profile, i.e., radial dimension, of the vane 40 aligned with the air flow to provide smooth exit flow at the trailing edge of the vane 40 when the turbine 10 is operating at baseload condition. The second configuration may be optimized for a second operating condition, e.g., the second configuration may generally provide for stage airflow efficiency, enhanced aeromechanics, smooth flow from stage to stage, reduced thermal stresses, enhanced interrelation of the stages to effectively pass the airflow from stage to stage, and/or reduced mechanical stresses in the second operating condition, which may be part-load condition. For example, the second configuration may include the profile, i.e., radial dimension, of the vane 40 aligned with the air flow to provide smooth exit flow at the trailing edge of the vane 40 over the full radial height of the vane 40 when the turbine 10 is operating at part-load condition. In particular, the second configuration may include the chord C of the vane 40 aligned to optimize the incidence angle of the air flow according to the specific radial flow condition, thereby providing smooth exit flow conditions over the full radial height of the vane 40.

Turning again to the illustration of FIG. 2, in some embodiments the inlet guide vane 34 may be a variable inlet guide vane 34 configured to rotate, e.g., the inlet guide vane 34 may be in mechanical communication with an actuator 46, such as a rotary actuator 46. In such embodiments, the rotary actuator 46 may be configured to rotate the entire vane 40 at once, e.g., the actuator 46 alone would not cause one of tip end 104 or hub end 106 to move relative to the other of tip end 104 or hub end 106 when the vane 40 is rotated.

Similarly, one or more of the stator vanes 40, e.g., Stage Zero, Stage One, and/or Stage Two stator vanes, may also be variable angle vanes in mechanical communication with an actuator 46. In other embodiments, the vanes 34, 40 may be fixed angle vanes which do not rotate relative to the casing 42 or other components of the turbine 10. Thus, in various embodiments, some, all, or none of the vanes 34, 40 may be variable angle vanes. That is, some or all of the inlet guide vane(s) 34 and/or stator vanes 40 may be actively morphable fixed vanes, e.g., where one of the tip end 104 or the hub end 106 is movable relative to the other of the tip end 104 or the hub end 106, and the other of the tip end 104 or the hub end 106 does not move relative to the casing 42 or other components of the turbine engine 10.

In some embodiments, for example as illustrated in FIGS. 3 and 4, the actuator 116 may be positioned at the hub end 106. In such embodiments, the actively morphable vane 40 may also include a connector 118, such as connector rod 118, in mechanical communication with the tip end 104 and the actuator 116. In particular, the connector 118 may be a connector rod 118 and the connector rod 118 may be connected to a center point of the tip end 104.

In some embodiments, for example as illustrated in FIGS. 5 and 6, the actuator 116 may be positioned at the tip end 104 and directly connected to the tip end 104. As illustrated in FIGS. 5 and 6, the actuator 116 may comprise a platform 116 directly connected to the tip end 104. Such configurations, e.g., wherein the actuator 116 is directly connected to the tip end 104, may permit applying torque directly to the tip end 104.

Figure 8:
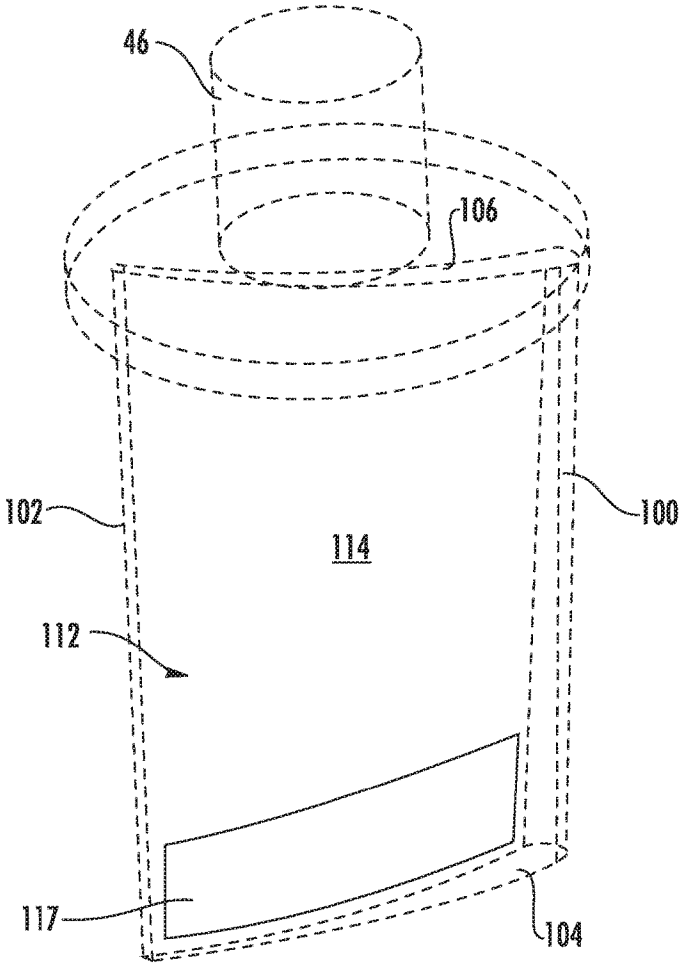
FIG. 8 is a suction side perspective view of the actively morphable stator vane of FIG. 7.
Figure 7:
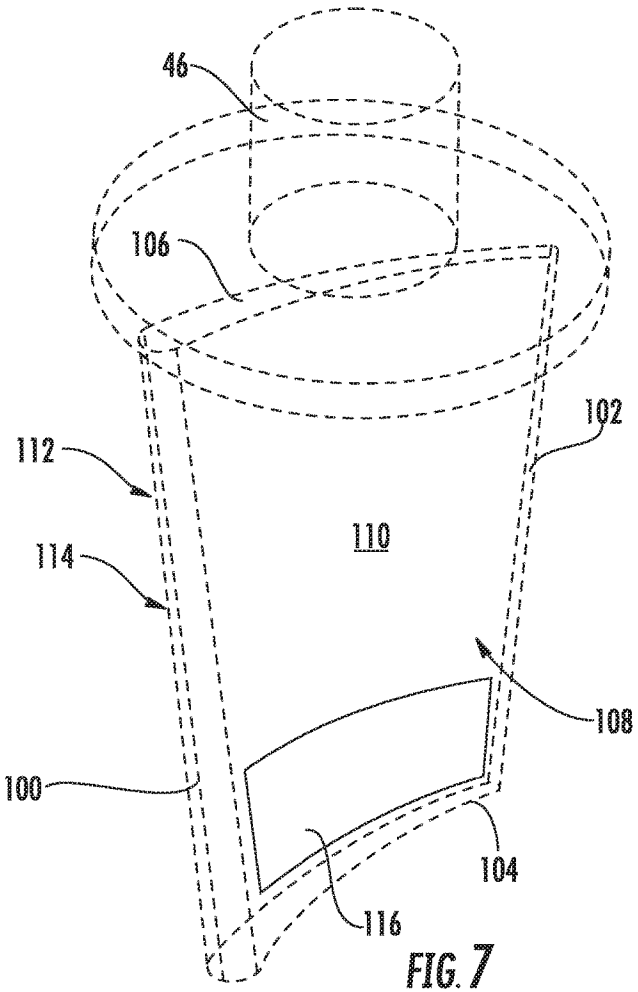
FIG. 7 is a pressure side perspective view of an actively morphable stator vane according to embodiments of the present disclosure.

In some embodiments, the actuator 116 may be a first actuator 116 and the actively morphable stator vane 40 may also include a second actuator 117. For example, as illustrated in FIGS. 7 and 8, in some embodiments, the first actuator 116 may be a first piezoelectric actuator 116 positioned on the pressure side 108 proximate to the tip end 104 and the second actuator 117 may be a second piezoelectric actuator 117 positioned on the suction side 112 proximate to the tip end 104. The first and second piezoelectric actuators 116, 117 may be positioned on the pressure surface 110 and the suction surface 114, respectively, or may be positioned on internal surfaces of the vane 40. For example, the first piezoelectric actuator 116 may be positioned on an internal surface of the vane 40 on the pressure side 108 proximate to the tip end 104. In some embodiments, the first piezoelectric actuator may be operable to expand in response to the electric current and the second piezoelectric actuator may be operable to contract in response to the applied electric current.

In embodiments such as the example illustrated in FIGS. 7 and 8, the actively morphable stator vane 40 may be configured in the second configuration by applying electric current to a piezoelectric actuator 116 or actuators 116 and 117. Thus, in some embodiments such as the example illustrated in FIGS. 7 and 8, the actuator 116, or actuators 116 and 117, may morph the actively morphable stator vane 40 without applying torque to the vane 40. Further, it is understood that twisting the vane 40, as described hereinabove regarding some example embodiments, is one example of morphing the vane 40, but is not the only way to selectively morph the actively morphable stator vane 40 between the first configuration and the second configuration. For example, in embodiments including piezoelectric actuator(s) 116 and 117, the angle between tip end 104 and hub end 106 may be substantially the same in both the first configuration and the second configuration, e.g., the actively morphable stator vane 40 may be morphed without twisting. In such embodiments, the shapes of the pressure surface 110 and the suction surface 114 may be changed by the piezoelectric actuator(s) 116 and 117 with little or no change in the angle of the tip end 104 and the hub end 106.

In some example embodiments, the vane 40, and in particular the flexible portions thereof, may comprise a composite material such as fiberglass or a carbon fiber reinforced polymer material. Such materials may advantageously provide enhanced flexibility in the portions of the actively morphable stator vane 40 where desired, such as the pressure side 108 and the suction side 112. In particular embodiments, such flexible materials may be advantageous when the actuator 116 is a piezoelectric actuator. The tip end 104 may comprise a less flexible material as compared to the pressure side 108 and the suction side 112. As noted above, tip end 104 may be sufficiently rigid that it does not change shape when torque is applied.

Figure 9:
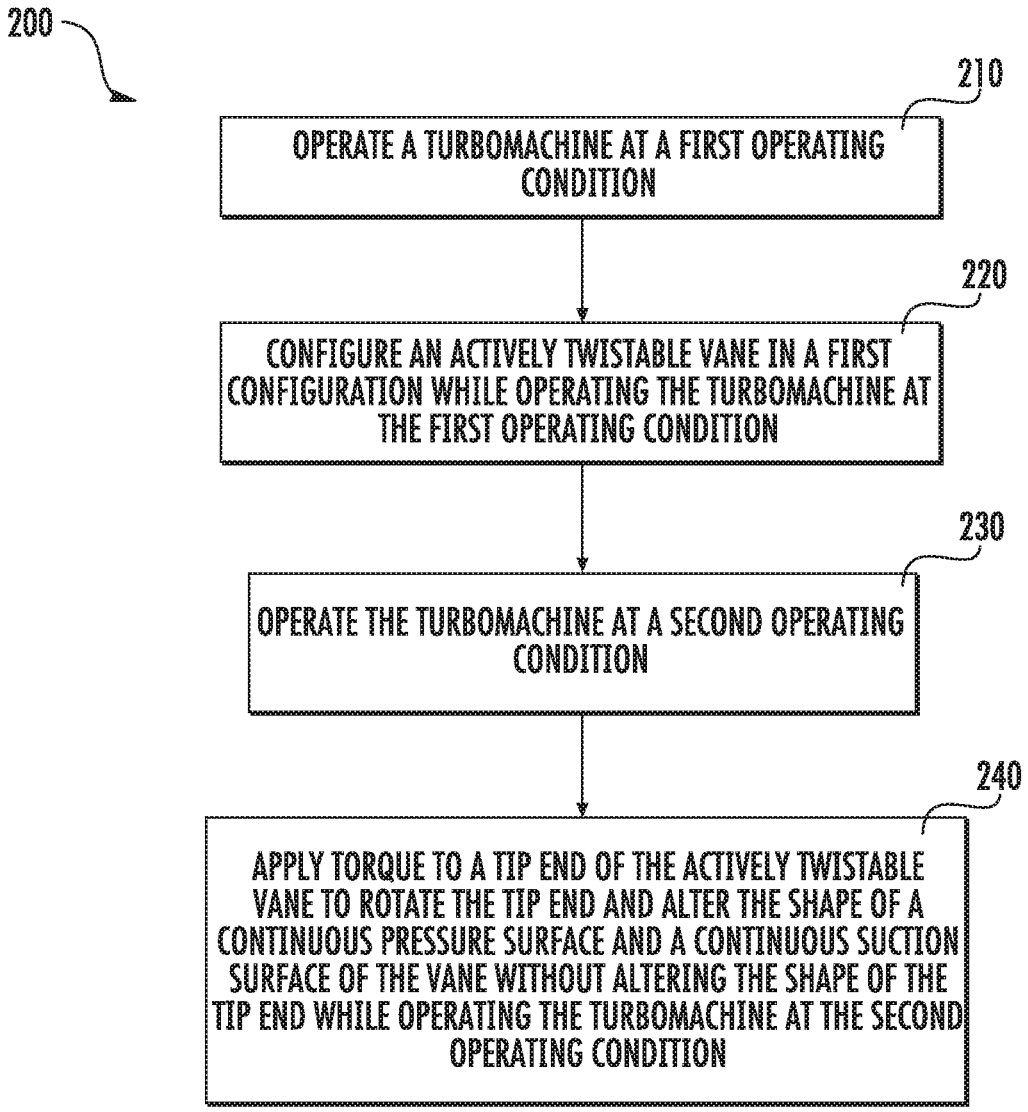
FIG. 9 is a flow chart illustrating a method of operating a turbomachine in accordance with embodiments of the present disclosure.

As illustrated in FIG. 9, some embodiments may include a method 200 of operating a turbomachine 10. The turbomachine 10 may include a compressor 14, the compressor 14 may include an actively morphable vane 40 having a continuous pressure surface 110 and a continuous suction surface 114. In some example embodiments, the method 200 may include a step 210 of operating the turbomachine 10 at a first operating condition. For example, the first operating condition may be a baseload condition, at which the efficiency of the turbomachine is optimized when the turbomachine 10, and in particular static compressor vanes 40 thereof, is in a first configuration. Thus, some example embodiments of the method 200 may include a step 220 of configuring the static compressor vanes, such as at least one actively morphable vane 40, in a first configuration while operating the turbomachine 10 at the first operating condition. In some example embodiments, the method 200 may further include a step 230 of operating the turbomachine 10 at a second operating condition. For example, the second operating condition may be a startup condition or a shutdown condition. In an additional example, the turbomachine 10 may be a gas turbine used to generate electricity, and the second operating condition may be a reduced load operation in response to varying electric grid demand. The method 200 may further include a step 240 of configuring the actively morphable vane 40 in a second configuration by altering the shape of the continuous pressure surface 110 and the continuous suction surface 114 while operating the turbomachine 10 at the second operating condition. In some embodiments, the actively morphable vane 40 may also include a hub end 106 and a tip end 104 radially spaced from the hub end 106. The step 240 may further include applying a torque to the tip end 104 such that the tip end 104 rotates relative to the hub end 106, without altering the shape of the tip end 104.

The foregoing embodiments may be particularly advantageous for vanes with high profile heights, e.g., variable inlet guide vanes, inlet guide vanes, and first compressor rows, where the exit flow conditions at vane hub end 106 and vane tip end 104 may be different. The ability to morph the vane 40, e.g., by rotating the tip end 104 relative to the hub end 106, may permit optimization of both the tip end exit flow condition and the hub end exit flow condition.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An actively morphable stator vane for a compressor, the actively morphable stator vane comprising:

a leading edge;

a trailing edge downstream of the leading edge;

a tip end;

a hub end spaced radially outward from the tip end;

a pressure side comprising a pressure surface, the pressure surface extending continuously between the tip end and the hub end and extending continuously between the leading edge and the trailing edge;

a suction side comprising a suction surface, the suction side positioned opposite of the pressure side, the suction surface extending continuously between the tip end and the hub end and extending continuously between the leading edge and the trailing edge; and an actuator in mechanical communication with the tip end, the actuator operable to selectively morph the actively morphable stator vane between a first configuration and a second configuration by altering the shape of the pressure surface and the suction surface, the first configuration optimized for a first operating condition, and the second configuration optimized for a second operating condition, wherein the actuator is positioned at the hub end, the actively morphable vane further comprising a connector in mechanical communication with the tip end and the actuator, wherein the connector is a connector rod and the connector rod is connected to a center point of the tip end.

2. The actively morphable stator vane of claim 1, wherein the leading edge and the trailing edge define a chord length therebetween, and the chord length in the first configuration is substantially the same as the chord length in the second configuration.

3. The actively morphable stator vane of claim 1, further comprising a tip end chord defined by a straight line extending from the leading edge to the trailing edge at the tip end, a hub end chord defined by a straight line extending from the leading edge to the trailing edge at the hub end, and an angle defined by the tip end chord and the hub end chord, wherein the angle is larger in the second configuration than in the first configuration.

4. The actively morphable stator vane of claim 1, wherein the vane comprises a composite material.

5. The actively morphable stator vane of claim 1, wherein the stator vane is a variable angle vane.

6. The actively morphable stator vane of claim 1, wherein the stator vane is a fixed angle vane which does not rotate relative to a casing of the compressor.

7. A method of operating a turbomachine, the turbomachine comprising a compressor, the compressor comprising an actively morphable stator vane, the actively morphable stator vane comprising a leading edge, a trailing edge downstream of the leading edge, a tip end, a hub end spaced radially outward from the tip end, a continuous pressure surface extending continuously between the tip end and the hub end and extending continuously between the leading edge and the trailing edge, and a continuous suction surface positioned opposite of the continuous pressure surface, the continuous suction surface extending continuously between the tip end and the hub end and extending continuously between the leading edge and the trailing edge, an actuator in mechanical communication with the tip end, wherein the actuator is positioned at the hub end, the actively morphable vane further comprising a connector in mechanical communication with the tip end and the actuator, wherein the connector is a connector rod and the connector rod is connected to a center point of the tip end, the method comprising: operating the turbomachine at a first operating condition; configuring the actively morphable stator vane in a first configuration while operating the turbomachine at the first operating condition; operating the turbomachine at a second operating condition; and configuring the actively morphable stator vane in a second configuration by altering the shape of the continuous pressure surface and the continuous suction surface while operating the turbomachine at the second operating condition.

8. The method of claim 7, wherein configuring the actively morphable vane in a second configuration comprises twisting the actively morphable stator vane.

9. The method of claim 7, wherein configuring the actively morphable stator vane in the second configuration comprises applying a torque to the tip end.

10. The method of claim 9, wherein the actively morphable vane comprises a tip end chord defined by a straight line extending from the leading edge to the trailing edge at the tip end, a hub end chord defined by a straight line extending from the leading edge to the trailing edge at the hub end, and an angle defined by the tip end chord and the hub end chord, and wherein applying a torque to the tip end comprises rotating the tip end relative to the hub end such that the angle defined by the tip end chord and the hub end chord is greater in the second configuration than in the first configuration, without altering the shape of the tip end.

* * * * *